US005600076A

United States Patent [19]

Fleming et al.

[11] Patent Number: 5,600,076

[45] Date of Patent: Feb. 4, 1997

[54] ENERGY MONITOR FOR A CENTRIFUGE INSTRUMENT

[75] Inventors: John A. Fleming, Newtown; William A. Romanauskas, Southbury, both of Conn.

[73] Assignee: Sorvall Products, L.P., Newtown, Conn.

[21] Appl. No.: 283,020

[22] Filed: Jul. 29, 1994

[51] Int. Cl.[6] ..... B04B 13/00

[52] U.S. Cl. ..... 73/865.9; 494/7

[58] Field of Search ..... 73/865.9; 340/679; 494/7–10

[56] References Cited

U.S. PATENT DOCUMENTS

| | | | |
|---|---|---|---|
| 4,205,261 | 5/1980 | Franklin | 318/480 |
| 4,515,582 | 5/1985 | Cox-Smith et al. | 494/7 |
| 4,601,696 | 7/1986 | Kamm | 494/10 |
| 4,827,197 | 5/1989 | Giebeler | 318/3 |
| 5,037,371 | 8/1991 | Romanauskas | 494/10 |
| 5,203,179 | 4/1993 | Powell . | |

FOREIGN PATENT DOCUMENTS

| | | |
|---|---|---|
| 3936202 | 6/1990 | Germany . |
| 57-50744 | 3/1982 | Japan . |
| 1131653 | 10/1968 | United Kingdom . |

*Primary Examiner*—Robert Raevis

*Attorney, Agent, or Firm*—Ohlandt, Greeley, Ruggiero & Perle

[57] ABSTRACT

An energy monitoring arrangement that is operatively associated with a centrifuge instrument monitors the magnitude of applied accelerating energy that is used to accelerate a rotor and to interrupt the continued application of accelerating energy if the magnitude of the applied accelerating energy exceeds a predetermined reference energy value. Preferably, the net applied accelerated energy to the rotor is monitored and used in the comparison with the energy reference. The invention may also be used in a predictive manner to provide, early in the centrifugation run, an indication of the energy of a rotor at an operator-ordered set velocity.

8 Claims, 4 Drawing Sheets

10
20
16
18
14
26
26
36
34
28
28
12
12
22
24
30
74
42
72
I
44
48
38
40
46
V
82
ω
60
86
72
82
44
84
K
50
APPLIED TORQUE SIGNAL GENERATOR
78
44
V
ω
T
60
86
82
I
72
72
APPLIED ACCELERATING POWER SIGNAL GENERATOR
CLOCK
54
APPLIED ACCELERATING ENERGY SIGNAL GENERATOR
62
64
66
68
POWER x TIME
56
60
COMPARE
E reference
58

$$F = \frac{(\omega_{set})^2}{\left[(\omega_b - \omega_a) \cdot (\omega_b + \omega_a)\right]}$$

ENERGY MONITOR FOR A CENTRIFUGE INSTRUMENT

BACKGROUND OF THE INVENTION

1. Field of the Invention

The present invention relates to a monitoring apparatus for a centrifuge instrument that monitors the energy applied to the instrument to accelerate a rotor mounted therein.

2. Description of the Prior Art

A centrifuge instrument is a device by which liquid samples may be subjected to a centrifugal force field. The sample is carried within a member known as a centrifuge rotor. The rotor is mounted at the top of a rotatable drive shaft that is connected to a source of motive energy.

The centrifuge instrument may accept any one of a plurality of different centrifuge rotors depending upon the separation protocol being performed. Whatever rotor is being used, however, it is important to insure that the rotor does not attain an energy level which exceeds the capacity of the energy containment system of the instrument.

The energy containment system includes all structural features of the centrifuge instrument which cooperate to confine within the instrument any fragments produced in the event of a rotor failure. These structural features include, for example, one (or more, concentric) guard ring(s), instrument chamber door and associated door latches. The energy containment system, however configured, has a predetermined energy containment threshold.

The total energy input to a system is equal to the sum of the energy dissipated in operation and the stored energy. In a centrifuge instrument the dissipated energy is that portion of the applied energy that is needed to overcome the inherent losses due to the mechanical drive system or due to fluid friction. This portion of the applied energy is dissipated as heat. The remaining portion of the applied energy is stored by the motion of the rotor. If the stored energy of a failed rotor exceeds the energy containment threshold of the instrument a fragment of the rotor may not be confined by the containment system, but may instead exit therefrom. Any fragment which exits the instrument presents an extremely serious threat of injury and/or damage. It is the stored energy that must thus be contained in the event of rotor failure.

The stored energy of motion, or the kinetic energy, of a rotor is directly related to its angular velocity, as specified by the relationship:

$$\text{Kinetic Energy} = \tfrac{1}{2}(I\,\omega^2) \qquad (1)$$

where I is the moment of inertia of the rotor, and where $\omega$ is its angular velocity.

Presently, the most direct manner of limiting rotor energy is to limit the velocity (i.e., the angular velocity), or the speed, that the rotor is able to attain.

One manner of rotor speed limitation is achieved by windage limiting the rotor. Windage limitation is a passive speed limitation technique. Windage limitation is achieved by purposely designing the rotor is a way that any excess energy above that level necessary to overcome frictional losses in the rotor drive system and to drive the rotor to predetermined safe speed is dissipated as windage, or air friction.

Another way to limit rotor speed is to provide an overspeed control system in the instrument that affirmatively, or actively, limits the speed at which each given rotor is allowed to spin. For an active overspeed control system to limit rotor speed effectively it is necessary to ascertain the identity of the rotor mounted in the instrument.

Rotor identity information may be directly derived from the operator by requiring that the operator input identity information to the control system prior to the initiation of a centrifugation run. However, to protect against the possiblity of an operator mistake, automatic rotor identity arrangements are used. These rotor identity arrangements automatically identify the rotor present on the drive shaft of the instrument and, based on this identification, permit only that energy to be applied to the rotor to permit it to reach a predetermined allowable speed.

Various forms of automatic rotor identity arrangements are known. In one form each rotor in a rotor family carries a speed decal having bands or sectors of differing light reflectivity. The pattern on the decal contains a code to establish rotor identity. The code is read by an associated sensor at a predetermined low angular velocity. U.S. Pat. No. 4,205,261 (Franklin) is representative of this form of rotor identity arrangement. In another form each rotor in the family carries a predetermined pattern of magnets. The magnets are sensed by a suitable detector, typically a Hall Effect device, to read the rotor code. U.S. Pat. No. 4,601,696 (Kamm) is representative of this form of rotor identity arrangement.

Other forms of automatic rotor identity arrangements sense a particular parameter of rotor construction in order to identify the rotor. In the arrangement disclosed in U.S. Pat. No. 5,037,371 (Romanauskas), assigned to the assignee of the present invention, the shape of a rotor mounted on the drive shaft is interrogated ultrasonically to generate a signal representative of the rotor's identity. In U.S. Pat. No. 4,827,197 (Giebeler) the inertia of the rotor mounted on the shaft is detected and used a the basis of a rotor identity signal.

Because each of the above-discussed forms of automatic rotor identity arrangement is focused toward the use of secondary, rotor-based characteristics, an additional layer of complexity is added to the rotor speed control scheme beyond a basic speed control determination. Accordingly, for the sake of simplicity, it is believed advantageous to provide an instrument control system that uses available basic, readily ascertainable information associated with instrument operation to limit energy applied to the rotor and thereby to prevent the stored energy of the rotor from reaching a value that challenges the energy threshold of the energy containment system of the instrument.

SUMMARY OF THE INVENTION

The present invention is directed to an energy monitoring arrangement that is operatively associated with a centrifuge instrument and monitors the magnitude of applied accelerating energy that is used to accelerate a rotor and to interrupt the continued application of applied accelerating energy if the magnitude of the applied accelerating energy exceeds a predetermined reference energy value. In the preferred instance the net applied accelerated energy to the rotor is monitored and used in the comparison with the energy reference. The invention may also be used in a predictive manner to provide, early in the centrifugation run, an indication of the energy of a rotor at an operator-ordered set velocity.

BRIEF DESCRIPTION OF THE DRAWINGS

The present invention will be fully understood from following detailed description thereof, taken in connection with the accompanying drawings, which form a part of this application, and in which.

DETAILED DESCRIPTION OF THE INVENTION

Figure 1:
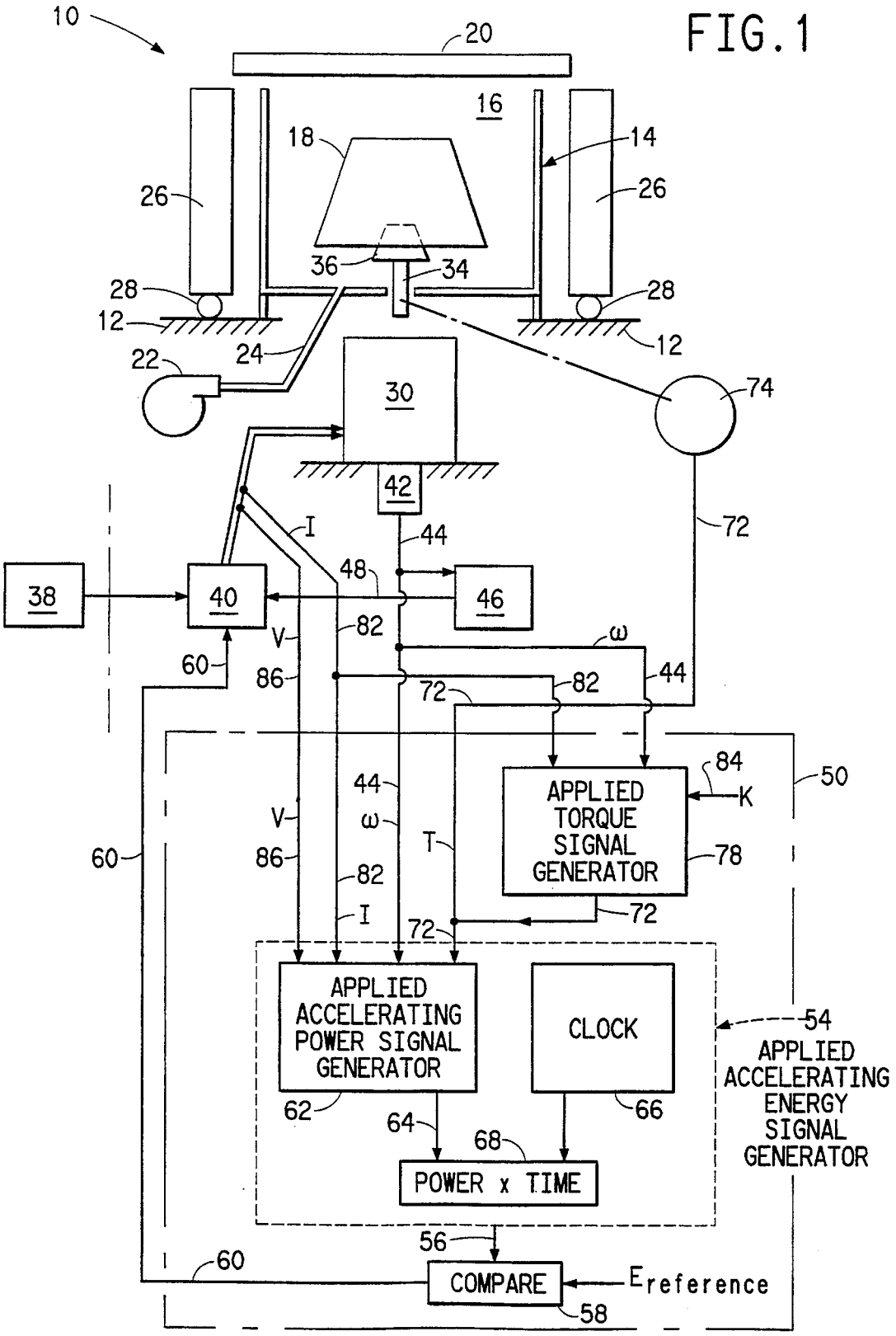
FIG. 1 is a stylized pictorial representation of a centrifuge instrument with which an applied energy monitoring arrangement in accordance with the present invention may be used, the applied energy monitoring arrangement being illustrated in block diagram form.

Throughout the following detailed description, similar reference numerals refer to similar elements in all Figures of the drawings.

With reference to FIG. 1 shown is a stylized pictorial representation of a centrifuge instrument generally indicated by the reference character 10 with which an applied energy monitoring arrangement in accordance with the present invention may be used. The applied energy monitoring arrangement is itself generally indicated by the reference character 50.

The centrifuge instrument 10 includes a framework schematically indicated at 12. The framework 12 supports a bowl 14. The interior of the bowl 14 defines a generally enclosed chamber 16 in which a rotating element, or rotor 18, may be received. Access to the chamber 16 is afforded through a door 20. The bowl 14 may be provided with suitable evaporator coils (not shown) in the event that it is desired to refrigerate the bowl 14, the rotor 18 and its contents. The bowl 14 may be evacuated by a suitable vacuum pump 22 that is connected to the bowl 14 through a vacuum line 24.

One or more energy containment members, or guard ring(s) 26 is(are) carried by the framework 12. Each guard ring 26 is arranged concentrically with respect to the bowl 14. The guard ring(s) 26, together with the door 20 (and its associated mounting latches) form the energy containment system of the instrument 10. The guard ring 26, positioned as it is, serves to absorb the kinetic energy of the rotor 18 should a catastrophic failure of the rotor 18 occur and fragments thereof escape the chamber 16. The guard ring 26 may be movably mounted within the framework 12 to permit flee rotation of the ring 26 to absorb any rotational component of the energy of a rotor fragment.

A motive source 30 is mounted within the framework 12. Mechanically, the motive source 30 is connected to or includes a drive shaft 34. The drive shaft 34 projects into the chamber 16. The upper end of the shaft 34 is terminates in a mounting spud 36 that is configured to receive thereon any one of a predetermined number of rotor elements. The shaft 34 of the source 30, the mounting spud 36, and the associated bearings and the like collectively constitute the rotating system onto which the rotor 18 may be mounted.

The motive source 30 may be implemented in any one of a well-known variety of forms, such as a brushless DC electric motor, an induction motor, or an oil turbine. However implemented the motive source 30 exhibits a predetermined torque versus rotational speed (i.e., angular velocity) characteristic. The maximum torque/speed characteristic of the source 30 may be derived empirically by mapping the torque output at various angular velocities using a rotor 18 having a predetermined inertia associated therewith. The source should be operating at maximum power level and at its optimal efficiency when deriving the characteristic. The torque/speed characteristic, once mapped, is the same for any rotor, regardless of moment of inertia.

In the preferred case the motive source 30 is implemented utilizing a brushless DC electric motor, such as the motor manufactured and sold by Servomagnetics Inc., Canoga, Calif., operating under the control of a suitable motor drive controller, such as that manufactured by Automotion Machine Products, Ann Arbor, Mich.

A brushless DC electric motor exhibits a predetermined motor constant K. The motor constant K is a measure of the torque output of the motor at an applied unit of current. The motor constant K may be measured electrically by measuring the average voltage being applied to the motor while the motor shaft is rotated at a predetermined angular velocity.

Power is applied to the motive source 30 from an electric power source 38 that is disposed externally to the instrument. A switch network 40, configured from an array of power field effect transistors (MOSFET) or a hydraulic valve, is connected between the power source 38 and the motive source 30. The switch network 40 serves to control the amount of power that is applied from the power source 38 to the motive source 30. When the motive source 30 is implemented using an electric motor, electric power from the source 38 directly drives the source 30 (via the switch network 40). When the motive source 30 is implemented in the form an oil turbine the electric power source 38 is connected (via the switch network 40) to a oil pump, and thus indirectly drives the motive source 30.

A tachometer generally indicated by the reference character 42 is arranged to monitor the rotational speed (i.e., the angular velocity) of the rotating system that includes the shaft 34 and a rotor mounted thereon. Any convenient form of tachometer arrangement may be utilized and remain within the contemplation of the present invention. An electrical signal representative of the actual angular velocity of the rotating system and of a rotor 18 mounted thereon is carried from the tachometer 42 on an output line 44.

The output signal on the line 44 representative of the angular velocity of the rotating system and the rotor 18 thereon is monitored by a rotor velocity controller generally indicated by the reference character 46. The velocity controller 46 may be implemented in any convenient fashion, as by a microprocessor-based control system operating in accordance with a program. The same microprocessor based control system may be used to implement the overall instrument control functions, as is apparent to those skilled in the art.

The controller 46 responds to the velocity signal on the line 44 and controls the switch network 40 to limit the current applied to the motive source 30. If the rotor velocity exceeds a predetermined velocity threshold a signal on a line 48 from the controller 46 to the network 40 opens the same to interrupt the application of power to the motive source 30.

In operation, the motive source 30 converts power applied from the power source 38 to drive torque. The drive torque generated by the motive source 30 causes the rotating system (and the rotor 18 thereon) to rotate and to accelerate to increasingly higher angular velocities.

Figure 3:
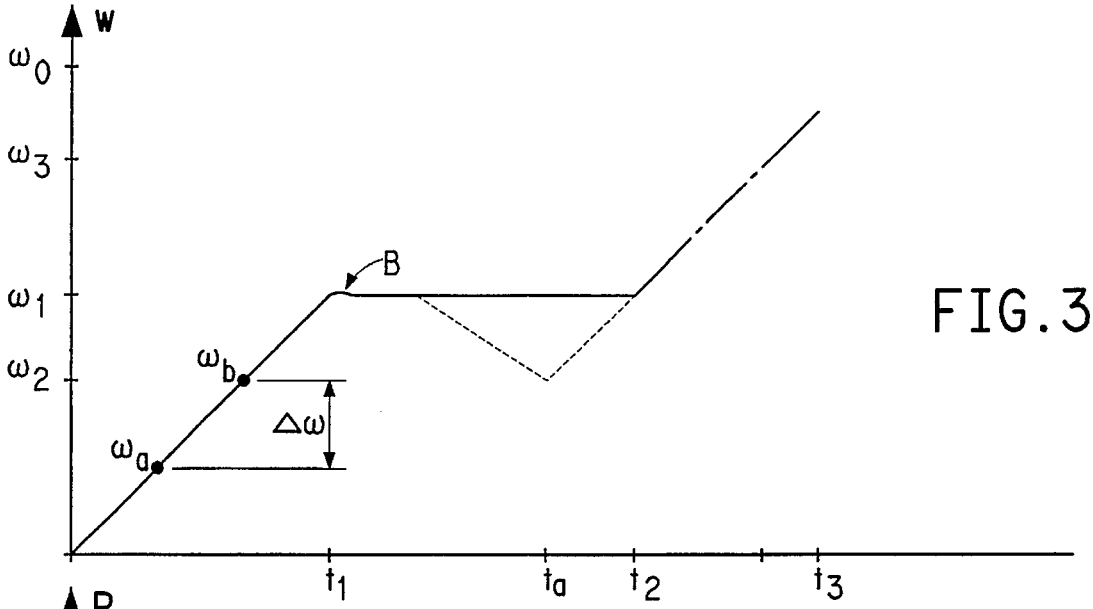
FIGS. 2, 3 and 4 are generalized graphical representations illustrating various operating parameters of a centrifuge instrument whereby an understanding of the principles underlying the applied energy monitoring arrangement in accordance with the present invention may be obtained.
Figure 2:
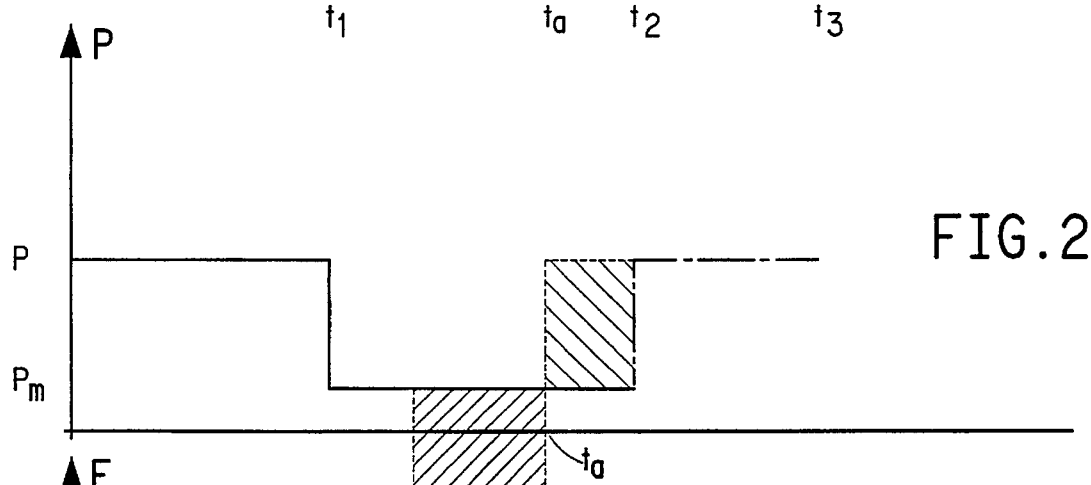
Figure 4:
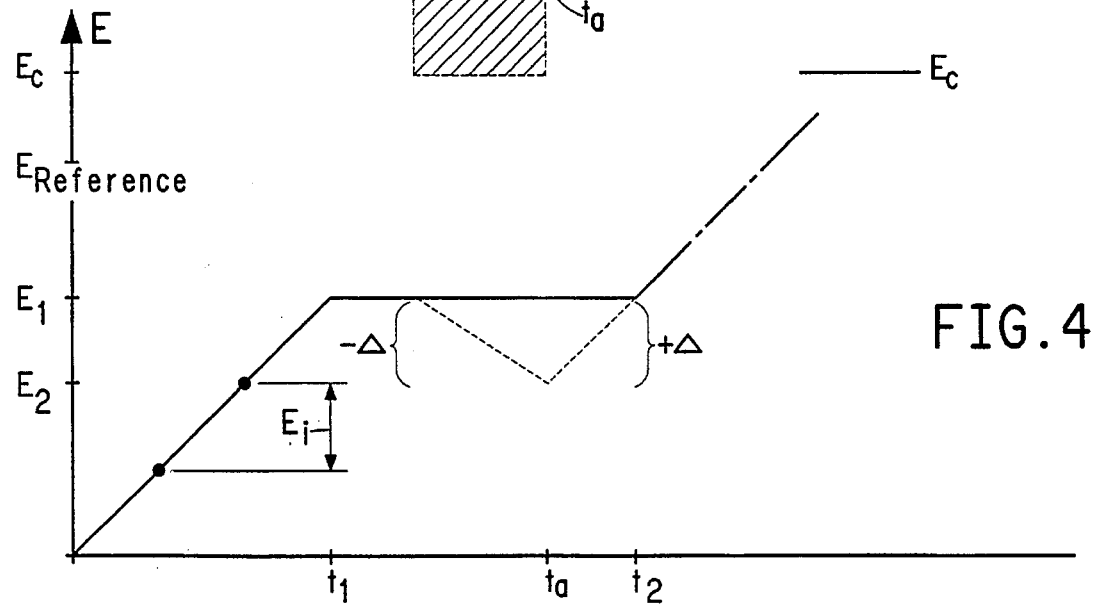

In order to understand the principles of the present invention the power P applied to the motive source 30, the angular velocity co of the rotor 18, and the total energy E applied by the motive source 30 to accelerate the rotor 18, all during the course of a hypothetical basic centrifugation run, are graphically plotted in FIGS. 2, 3 and 4, respectively. Each of the listed variables is plotted with respect to time t.

Since the precise shape of the various curves is dependent upon the characteristics of the motive source and its drive, the curves shown in FIGS. 2 through 4 are intended as generalized and simplified qualitative representations, and should not be construed as reflecting the relationships of the variables with mathematical precision. For example, it is acknowledged that FIG. 2 literally illustrates a situation in which constant power from time=0, an obvious impossibility. The linear shape of the curve in FIG. 3 is also inconsistent with the assumed constant power and the energy conditions of FIGS. 2 and 4.

For purposes of discussion it is assumed that the protocol being implemented requires the rotor 18 to rotate at a predetermined velocity $\omega_1$. FIG. 2 shows that the power from the power source 38 and applied to the motive source 30 is constant over time. As is apparent from FIG. 3, during the period from $0<t<=t_1$ the motive source 30 converts the applied power P into a drive torque T that accelerates the rotor 18 from rest toward the predetermined operating angular velocity $\omega_1$. Assuming proper operation of the velocity controller 46, under a normal operational sequence the angular velocity of the rotor 18ramps upwardly (i.e., accelerates) toward and levels at the desired velocity value $\omega_1$, as shown by the solid line in FIG. 3. In practice, the velocity/time characteristic of the rotor 18 may, in fact, be permitted to slightly overshoot the velocity $\omega_1$ and form a "bend", or "knee", as illustrated at the reference character B.

Once the desired angular velocity value $\omega_1$ is reached, at the time $t_1$, the velocity controller 46 maintains the rotor's angular velocity at the desired value $\omega_1$ by limiting the power P applied to motive source 30 to the maintenance power level $P_m$. The maintenance power level $P_m$ is, in practice, a small fraction (usually on the order of ten percent) of the power level applied during the acceleration of the rotor. Nevertheless, the maintenance power level $P_m$ is sufficient to generate the torque T that is required to overcome the losses in the drive system and hold the rotor at its angular velocity at the desired value $\omega_1$.

FIG. 4 illustrates the above-discussed hypothetical basic centrifugation run during the time interval $0<t<=t_1$ from the energy perspective. During the time interval $0<t<=t_1$ the applied energy accelerates the rotor toward the velocity $\omega_1$. The magnitude of the accelerating energy is, by definition, the time integral of the applied power and may graphically be envisioned as the area under the power/time curve of FIG. 2 in the time interval $0<t<=t_1$. The energy $E_1$ applied to the motive source 30 from the power source 38 to accelerate the rotor 18 to the desired velocity value col is equal to the area beneath the applied power curve shown in FIG. 2 in the time interval $0<t<=t_1$. The applied energy used to accelerate the rotor 18 (the "applied accelerating energy") is stored by the rotor and manifests itself as the kinetic energy of the rotating rotor, quantified in accordance with the relationship given by Equation (1).

It should be noted that the maintenance power $P_m$ applied to the motive source 30 during in the time interval $t_1<t<=t_2$ does not serve to increase rotor velocity of the rotor 18, and hence does not contribute toward any running total of applied accelerating energy. The maintenance energy, that is, the time integral of the applied maintenance power during the time interval $t_1<t<=t_2$, is dissipated by the various system losses (e.g., windage loss (if any), bearing or drive loss).

Assume, however, for purposes of discussion that at the later time $t_2$ the controller 46 fails. In that event the power P applied to the motive source 30 is no longer limited to the maintenance power level $P_m$. Instead, the motive source 30 continues to convert applied power into torque and the torque so generated accelerates the rotor 18 beyond the desired operating angular velocity $\omega_1$. This circumstance is indicated by the dot-dashed portion of the curve in FIGS. 2 through 4. It will be appreciated that in a windage limited (i.e., non-evacuated) operational situation an overspeed condition is generally prevented because at some point the generated torque is not sufficient to overcome fluid frictional effects. The rotor is not able to be accelerated beyond some predetermined windage velocity value. The windage angular velocity value is below the rotor's predetermined overspeed angular velocity value $\omega_o$. However, if the rotor is being operated in an evacuated environment (or, if rotor windage is not sufficient to limit rotor speed below the overspeed angular velocity value $\omega_o$) then the continued application of power causes the rotor to accelerate toward its overspeed angular velocity value $\omega_o$. This occurrence raises the specter of a catastrophic rotor failure.

The ramifications of the failure of the controller 46 from the energy point of view are seen in FIG. 3. As the total of applied accelerating energy increases the rotor's angular velocity is also increased, commensurately increasing the energy stored by the motion of the rotor. The stored energy of the rotor may possibly achieve an energy level that would exceed the containment energy threshold (indicated by the character $E_c$ in FIG. 3) able to be withstood by the energy containment system of the instrument 10.

However, it should be recognized from the foregoing that if the energy applied to the source 30 were interrupted at some predetermined energy level $E_{reference}$ that is below the containment energy threshold $E_c$, then the possibility of the rotor ever achieving a stored energy level that challenges the containment energy threshold of the instrument would be precluded. Such a recognition is the underpinning of the applied energy monitoring arrangement 50 of the present invention.

Generally speaking, the applied energy monitoring arrangement 50 includes means generally indicated by the reference character 54 that is operatively associated with the instrument 10 and is responsive to signals representative of various parameters thereof in a manner to be described to generate a signal representative of the magnitude of applied energy that is used to accelerate a rotor. The applied accelerating energy signal is carried on a line 56. The applied energy monitoring arrangement 50 further includes means generally indicated by the reference character 58 for comparing the magnitude of applied accelerating energy signal on the line 56 to a predetermined reference value representative of the energy $E_{reference}$. If the magnitude of applied accelerating energy exceeds the reference energy value a control signal on a line 60 is generated. The control signal may be applied to the switch 40 which serves to interrupt the application of energy to the instrument to prevent the rotor from achieving a stored energy in excess of the containment threshold.

As discussed in connection with FIG. 4, applied accelerating energy is the time integral of applied accelerating power. Accordingly, in the embodiment of the applied energy monitoring arrangement shown in the block diagram portion of FIG. 1 the applied accelerating energy signal generating means 54 comprises: means 62 for generating a signal on an output line 64 representative of the power applied to the motive source 30 to accelerate the rotor 18; a clock 66 for measuring the time interval during which the rotor accelerates upon the application of applied power; and means 68 responsive both to the applied power signal on the line 64 and to the clock 66 for generating the applied accelerating energy signal on the line 56.

The applied accelerating power signal generating means 62 may itself be realized in a variety of ways.

Mechanically, power may be expressed as the product of torque and speed. This relationship suggests ways of generating the applied accelerating power signal on the line 64 compatible with any form in which the motive source 30 is implemented. A signal representative of the torque T applied to the rotating system (shaft) by the motive source 30 may be input to the applied power signal generator 62 over the line 72. The output signal on the line 44 from the tachometer 42 representing the angular velocity of the rotating system (shaft) is also applied to the means 62. Using such inputs the means 64 generates the applied power signal on the line 64.

The applied torque signal on the line 72 may be acquired in various ways. For example, torque may be directly measured using a suitable torque meter 74 operatively coupled to the shaft 34. The meter 74 is diagrammatically indicated in FIG. 1. Suitable for use as the meter are torque measuring transducer devices (such as models TQ-100, TQ-320, or TM72-18) manufactured and sold by Vibrac Corporation, Amherst, N.H.

Alternatively, the means 54 may further include an applied torque signal generating means 78. The applied torque signal generating means 78 may, in one instance, take the form of a look-up table that stores the predetermined torque versus angular velocity characteristic exhibited by the motive source 30. In response to the signal on the line 44 representative of the angular velocity of the shaft 34 the applied torque signal in accordance with the torque/angular vleocity characteristic is output on the line 72. This implementation is believed best used when maximum acceleration is desired and maximum torque is used. For other (i.e., non-maximum) acceleration situations, other embodiments of the invention should be used.

The torque output of an electric motor is functionally related by the motor constant K to the applied current. Accordingly, the applied torque signal generating means 78 may utilize this relationship when the motive source 30 is, as preferred, implemented using an electric motor. To this end a signal on the line 82 representative of the applied motor current and a signal on a line 84 representing the predetermined constant K of the motor may be applied to the torque signal generating means 78 to produce the applied torque signal on the line 72.

Electrically, power is the product of current and voltage. Accordingly, if the motive source 30 is implemented using an electric motor, then the signal representative of the applied motor current on the line 82 and a signal representative of the applied voltage on a line 86 are input directly to the applied power signal generator 62. The means 62 uses these inputs to generate the applied accelerating power signal on the line 64. The signal representative of the current on the line 82 may be actually measured, or, if more convenient, the current value as commanded by the overall instrument control may be assumed to be the current level applied to the motive source 30.

In the preferred instance the applied energy monitoring arrangement 50 of the present invention is implemented using a microprocessor-based computer controller operating in accordance with a suitable program. Under program control the microprocessor and/or various registers within the control are configured to perform the various signal generation functions of the means 54, 62, 68, 78, the comparison function of the means 58. A separate read-only memory may be used to realize the look-up table implementation of the means 78. The internal clock of the controller may be used for the timing signals form the clock 66.

A suitable program, written in Borland C++ language that implements one embodiment of the present invention is set forth below. The program serves to calculate the change in rotor energy by forming the product of torque, velocity ("nowspeed" in the listing) and time. The program uses the last commanded current value, as output from the microprocessor based control to compute the torque. The velocity is scaled in units of RPM, time is 0.440 second cycle times, and the torque is scaled to units of foot-pounds. If the result of the comparison of the calculated energy and the energy reference ("toomuch") is true, then energy to the power source will be disconnected bringing the rotor to zero speed. The term "DS TO SPEED" in the listing refers to a machine state in which the instrument is responsive to speed controlling inputs. The term "State<5" refers to a particular subroutine in the machine state in which the instrument is operating.

Start Program

```
toomuch = 750000;
if ((state =DS_TO_SPEED)&&(to_state < 5)&&(dV > 0))//TRP
// Added     Torque

// Total     During                          Current              Scale

// Energy    Interval  ×                     Speed  ×     Time ×   Factor

//    |         |                              |          |        |

//    V         V                              V          V        V

//_____    _________                     _________    ______   ______

   energy+=((lastdac-Kv*nowspeed)*5/4096*   (nowspeed) *    (0.440) *  (0.0065)

if(energy >=toomuch)HighRotorEnergy = TRUE); //TRP
```

The principle underlying a more refined aspect of the applied energy monitoring arrangement 50 of the present invention may be understood by referring again to FIGS. 2 through 4.

It is possible that after the rotor 18 has reached its predetermined operating angular velocity $\omega_1$ (i.e., at some time during the velocity maintenance phase following the time $t_1$) the rotor's velocity may actually begin to decrease. This occurrence is illustrated in FIG. 3 by the dotted line portion of the curve in the time interval $t_1<t<t_a$ (where $t_1<t_a<t_2$) At the time $t_a$ the angular velocity of the rotor 18 is shown to have diminished from the value $\omega_1$ to the lesser value $\omega_2$. This occurrence may be viewed as the application of negative power, as indicated by the single hatched portion of the power/time curve of FIG. 2.

Moreover, it is also possible that at some point following the diminution in speed, for example, at the time $t_a$, the particular centrifugation protocol being practiced may require the velocity of the rotor increase toward a velocity $\omega_3$ greater than the operating angular velocity $\omega_1$. This occurrence is illustrated the time interval $t_a<t<t_3$ (where $t_2<t_3$).

The point to be noted is that although accelerating power and energy are being applied to the rotor 18 during the interval $t_a<t<t_2$, during this interval the velocity of the rotor is still less than the velocity $\omega_1$. Only after the time $t_2$ does the rotor velocity exceed the initial operating velocity $\omega_1$ reached at the time $t_1$.

FIG. 4 illustrates the situation depicted in the region $t_1<t<t_3$ of FIG. 3 from the energy point of view. The diminution in rotor velocity during the time interval from $t_1$ to the time $t_a$ results in a decrease in the rotational energy stored in the rotor. The magnitude of the decrease is indicated by the character $-\Delta$. At the time $t_a$ the rotor 18 has a stored energy value $E_2$ which is less than the stored energy $E_1$ of the rotor at the time $t_1$. The increment of accelerating energy indicated by the character $+\Delta$ on the energy curve in FIG. 4 (created to the application of the accelerating power to the rotor illustrated by the cross hatched portion of the power curve during the time $t_a<t<t_2$) serves only to compensate for the decrease in stored energy that occurs during the time $t_1<t<t_a$. Thus, at the time $t_2$ the rotor has only regained its previous stored energy level $E_1$. It is only after the time $t_2$ that the continued application of accelerating power results in a net increase in the value of results in a net increase in the accelerating energy applied to the rotor.

It may thus be appreciated that if the applied energy monitoring arrangement 50 is configured to monitor the applied accelerating energy of the rotor, without qualification, circumstances such as those discussed in connection with FIGS. 2 through 4 during the time interval $t_1<t<t_3$ may result in an erroneous energy value. To forestall this occurrence it lies within the contemplation of the present invention that the applied accelerating energy signal generating means 54 be configured in such a way that only the net energy applied to accelerate is monitored. In this way energy increments, such as that indicated by the character $+\Delta$ of FIG. 4 which serve only to restore a decrease in energy and to regain a previously attained energy level, is represented by the applied accelerating energy signal.

One convenient manner in which the applied energy monitoring arrangement 50 of the present invention may be modified in order to account for only the net applied accelerating energy is to maintain a running record of the previous highest velocity reached by the rotor. It may be appreciated that since it is at the highest previously reached velocity level that the highest stored energy value occurs, it follows that maintaining a running record of the rotor velocity and accumulating applied accelerating energy only when successively higher velocity levels are attained permits the control system to accumulate net applied accelerating energy. The applied energy monitoring arrangement 50 as implemented in any of the alternative forms presented above in connection with the discussion of the block diagram of FIG. 1 may be used in a manner which monitors the net applied accelerating energy.

Figure 5:
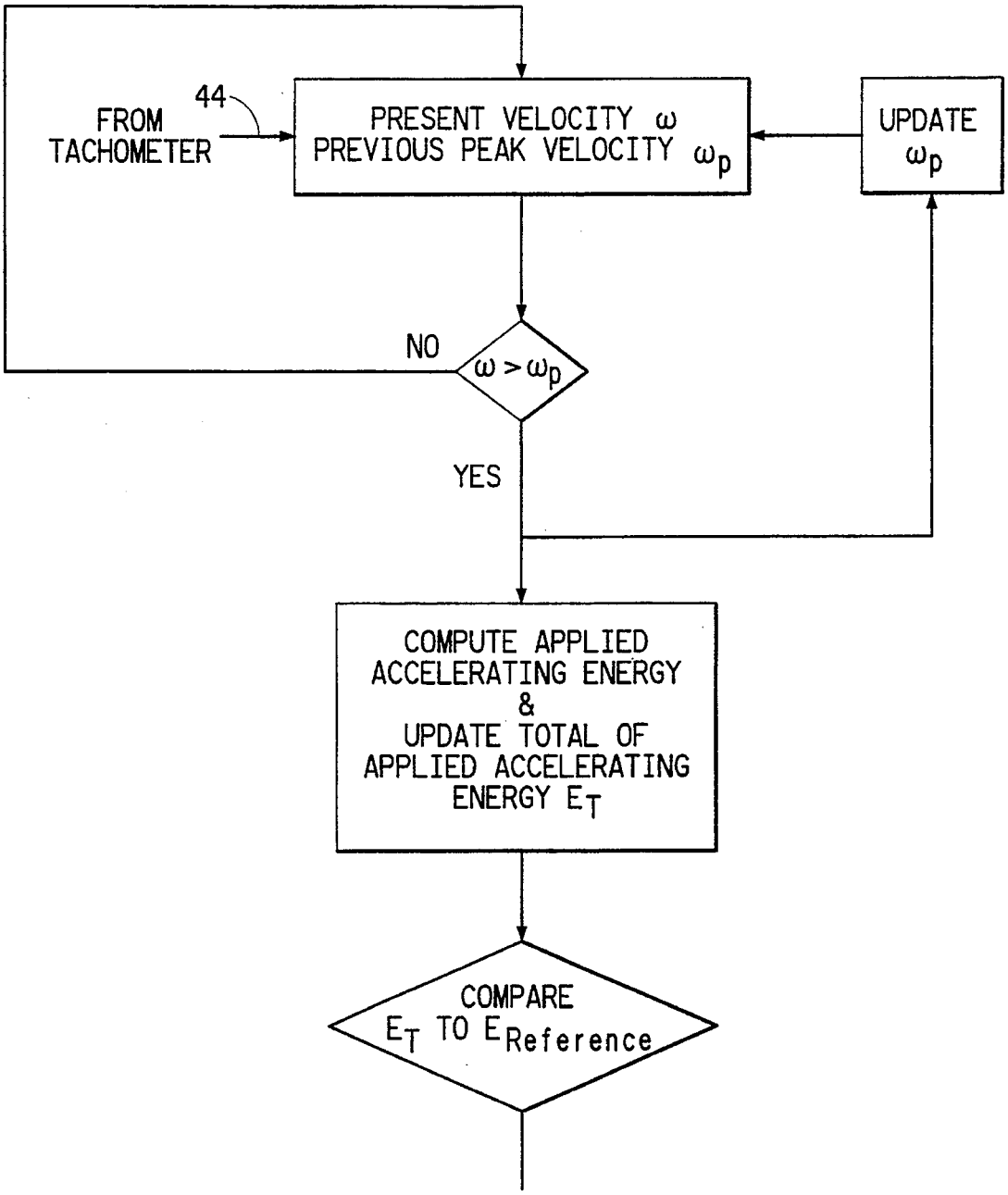
FIG. 5 is a flow diagram of a modification of the energy monitoring arrangement of the present invention.

FIG. 5 illustrates a flow diagram of a suitable program for a microcomputer-based implementation of this aspect of the invention.

The applied energy monitoring arrangement 50 of the present invention may be used as an instrument control system in its own right, or may serve in a failsafe role as a backup to another instrument speed controller. The latter role would be especially beneficial in those instance where governmental regulations, such as IEC standard 1010-2-2 requires containment testing under "single fault" conditions. This condition requires that in the event of any single component failure safety will not be compromised. Accordingly, if there exists an independent alternate control path, deleterious consequences associated with the failure of that component will be avoided.

Figure 6:
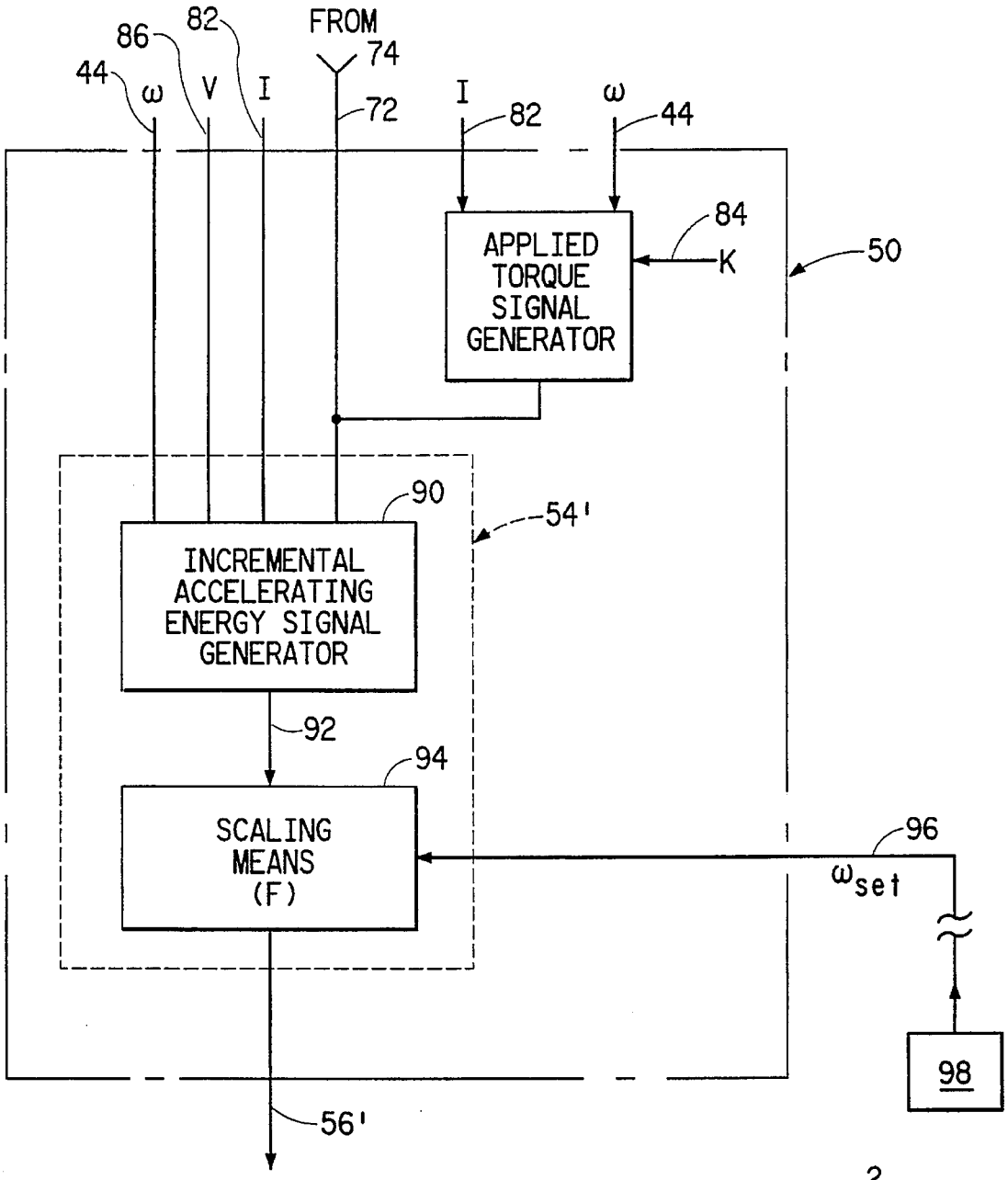
FIG. 6 is a block diagram of another modification of the energy monitoring arrangement of the present invention.

FIG. 6 is a block diagram of an applied energy monitoring arrangement 50 having a modified applied accelerating energy signal generating means 54'. The-applied accelerating energy signal output from the means 54' on the line 56 is derived in a predictive manner.

In accordance with this aspect of the invention the modified applied accelerating energy signal generating means 54' includes means 90 for generating a signal on a line 92 representative of the incremental energy. $E_i$ (FIG. 4) applied to accelerate the rotor a predetermined angular velocity increment $\Delta\omega$. The predetermined angular velocity increment $\Delta\omega$ (FIG. 3) is defined between predetermined first and second-angular velocities $\omega_a$ and $\omega_b$. Any of the previously discussed implementations of applied accelerating energy signal generating means 54 shown in the block diagram of FIG. 1 (accompanied by the applied torque signal generator 78, if necessary) may be used to implement the means 90 for generating the incremental applied accelerating energy signal on the line 92. To this end, all appropriate and necessary input signal lines (i.e., the lines 44, 72, 82 and/or 86) are connected to the modified applied accelerating energy signal generating means 54'.

The incremental applied accelerating energy signal on the line 92 is applied to scaling means 94. The scaling means 92 scales the incremental applied accelerating energy signal by a predetermined scaling factor F. The scaling factor F is defined in accordance with the following relationship:

$$F=(\omega_{set})2/(\omega_b 2-\omega_a 2) \quad (2)$$

or, equivalently, $$F=(\omega_{set})2/[(\omega_b-\omega_a)-(\omega_b+\omega_a)] \quad (2A)$$

where $\omega_a$ is a first predetermined angular velocity, and $\omega_b$ is a second predetermined angular velocity, and $\omega_{set}$ is an operator-determined rotor set angular velocity. The signal representative of the operator-determined rotor set angular velocity $\omega_{set}$ is applied on a line 96 from operator input means 98. The means 98 for inputting the predetermined operator-selected angular velocity represented by the $\omega_{set}$ may take the form of any suitable input device.

The output of the scaling means 94 defines a predicted applied accelerating energy signal on the line 56' that is compared in the comparator 58 (FIG. 1). If the predicted applied accelerating energy signal on the line 56' exceeds the reference, power to the motive source is interrupted.

The prediction should be preferably implemented during the centrifugation run at a point in time when the angular velocity increment yields a meaningful extrapolation. For example, in an application where the rotor chamber is evacuated at the start of a run, the prediction should be implemented at angular velocity equivalent to 2,000 RPM and 20,000 RPM (for $\omega_a$ and $\omega_b$, respectively) or at predetermined operator selected set speed (on the line 96) if the set speed for the run is below 20,000 RPM.

It should also be apparent that if the angular velocity at beginning of the run was selected (i.e., $\omega_a$=0) then, in effect, only a single angular velocity value (the value $\omega_b$) need be used. This prediction would be more meaningful for situations in which the rotor chamber is not evacuated and in which machine conditions are more stable.

Those skilled in the art, having the benefit of the teachings of the present invention may impart numerous modifications thereto. Such modifications are to be construed as lying within the scope of the present invention, as defined by the appended claims.

What is claimed is:

1. An applied energy monitoring arrangement for a centrifuge instrument, the instrument being operable to rotate a rotor, the instrument having an energy containment system therein, the energy containment system having a predetermined containment energy threshold $E_c$ associated therewith, the containment energy threshold being representative of the energy able to be withstood by the containment system of the instrument in the event that a failure of a rotor produces a fragment the applied energy monitoring arrangement comprising;

means for generating a signal representative of the energy applied to accelerate a rotor; and means for comparing the signal representative of the applied accelerating energy to a predetermined reference energy value $E_{ref}$ the reference energy value $E_{ref}$ being below the containment energy threshold $E_c$ of the instrument.

2. The applied energy monitoring arrangement of claim 1 wherein the centrifuge instrument has a motive source, and wherein the applied accelerating energy signal generating means comprises:

means for generating a signal representative of the power applied to the motive source to accelerate the rotor;

means for measuring the time interval during which the applied power accelerates the rotor;

means responsive to the signal representative of the applied power and to the time interval to generate the signal representative of the applied accelerating energy.

3. The applied energy monitoring arrangement of claim 2 wherein the motive source of the instrument is an electric motor responsive to an applied current at an applied voltage, wherein the applied power signal generating means comprises:

means responsive to the applied current and to the applied voltage to generate a signal representative of the electric power applied to the electric motor.

4. The applied energy monitoring arrangement of claim 2 wherein the instrument includes a rotatable shaft onto which the rotor may be mounted, and wherein the applied power signal generating means comprises:

means for generating a signal representative of the torque applied to the shaft by the motive source; and a tachometer for generating a signal representative of the angular velocity of the shaft.

5. The applied energy monitoring arrangement of claim 4 wherein the motive source of the instrument is an electric motor responsive to an applied current and exhibiting a predetermined motor constant, and wherein the applied torque signal generating means comprises:

means responsive to signals representative of the applied motor current and to the predetermined motor constant for generating the applied torque signal.

6. The applied energy monitoring arrangement of claim 4 wherein the motive source of the instrument has a shaft on which the rotor is mounted, and wherein the applied torque signal generating means comprises a meter operatively connected to the shaft for measuring the torque applied thereto.

7. The applied energy monitoring arrangement of claim 4 wherein the motive source of the instrument exhibits a predetermined torque versus angular velocity characteristic derived using a rotor having a predetermined inertia, and wherein the applied torque signal generating means comprises:

a tachometer for generating a signal representative of the angular velocity of the shaft; and means responsive to the rotational speed signal for generating the applied torque signal in accordance with the predetermined torque versus angular velocity characteristic.

8. The applied energy monitoring arrangement of claim 1 wherein the instrument comprises input means for introducing an operator-determined set velocity, and wherein the applied energy signal generating means comprises:

means for generating a signal representative of the increment of energy applied to accelerate the rotor to an angular velocity increment defined between predetermined first and second angular velocities; and means for scaling the signal representative of the energy increment by a predetermined scaling factor, the scaling factor being defined by the square of the operator-determined set velocity divided by the product of the sum of the first and second angular velocities and the difference between the first and second angular velocities.

* * * * *